US005094162A

United States Patent [19]

Tafel et al.

[11] Patent Number: 5,094,162

[45] Date of Patent: Mar. 10, 1992

[54] OFFSET PRINTING MACHINE

[75] Inventors: Leonard I. Tafel, Mount Prospect; Theodore Costopoulos, Lisle, both of Ill.

[73] Assignee: A. B. Dick Company, Chicago, Ill.

[21] Appl. No.: 575,034

[22] Filed: Aug. 30, 1990

[51] Int. Cl.[5] ..... B41F 13/28

[52] U.S. Cl. ..... 101/137; 101/218

[58] Field of Search ..... 101/218, 247, 177, 143, 101/144, 137, 139, 185

[56] References Cited

U.S. PATENT DOCUMENTS 2,568,761 9/1951 Peyrebrune ..... 101/218

4,676,158 6/1987 Ishii et al. ..... 101/218

4,691,631 9/1987 Ishii et al. ..... 101/218

*Primary Examiner*—Clifford D. Crowder

*Attorney, Agent, or Firm*—Jones, Day, Reavis & Pogue

[57] ABSTRACT

A cylinder setting mechanism for a single or multi-color offset printing device in which a blanket cylinder moves eccentrically about a first pivot point to make contact with a master cylinder so that it can be inked and then subsequently moved eccentrically about a second pivot point to make contact with the impression cylinder to transfer the image to paper. The invention enables the first and second pivot points to be adjusted to compensate for wear, plate thickness, and paper stock. In addition, a stop is provided to ensure that there is a predetermined contact pressure between the surfaces of the blanket cylinder and the master cylinder. The stop is automatically adjusted when the toggle is adjusted for a different thickness plate so that the desired offset printing pressure between the master and blanket cylinder surfaces is held at the optimum level.

21 Claims, 4 Drawing Sheets

OFFSET PRINTING MACHINE

FIELD OF THE INVENTION

The present invention relates in general to an offset printing machine and in particular relates to an offset printing machine which has an accurate means of adjusting the machine to permit simultaneous coordinated control of two or more printing couples while still allowing for variances between such couples and for providing a simplified means of adjustment wherein the force vectors are of a magnitude and direction such that predetermined desired contact pressures are maintained between the blanket cylinder and the impression cylinder and the blanket cylinder and the master cylinder.

BACKGROUND OF THE INVENTION

Offset printing machines are well known in the art and include a master or plate cylinder having a plate for carrying a transferable image thereon and an impression cylinder for carrying paper to receive the image. A blanket cylinder is interposed between the master cylinder and the impression cylinder such that the blanket cylinder moves eccentrically about a first pivot point to make pressure contact with the master cylinder for receiving the image and subsequently moves eccentrically about a second pivot point for making pressure contact with the impression cylinder to transfer the image to the paper. Such a system is disclosed in U.S. Pat. No. 4,691,631.

Two-color offset printing machines are also known and they include a single impression cylinder, two master cylinders and two blanket cylinders. A first blanket cylinder is caused to move eccentrically about a first axis to make contact with a first master cylinder and receive the image therefrom and then move eccentrically about a second pivot point to make contact with the impression cylinder and transfer the first color to the paper on the impression cylinder. The impression cylinder then rotates to the other pair of master and blanket cylinders where the blanket cylinder moves eccentrically into contact with the second master cylinder to receive the second color and subsequently moves eccentrically into contact with the impression cylinder to transfer the second color to the paper. This system is also disclosed in U.S. Pat. No. 4,691,631.

In both single and multi-color such as two color offset printing machines, a predetermined contact pressure must be maintained between the blanket cylinder and the master cylinder and between the blanket cylinder and the impression cylinder. Thus, the mounts for eccentrically supporting the blanket cylinder are rotationally forced against a fixed but adjustable stop which is manually adjusted in the prior art to allow a desired amount of pressure at the contact points between the master and blanket cylinders and between the blanket and impression cylinders, respectively. Adjustment is time-consuming, but readjustment is required for wear and the like as the press is generally set up to print with a relatively fixed thickness of plates, blankets and paper stock. Adjustment, if it is required, is accomplished by varying the thickness of the packing sheets underneath the plate on the master cylinder or paper on the impression cylinder or blanket on the blanket cylinder.

Small sheet-fed presses, in particular, are required to accommodate a wide range of plate and paper stock thicknesses, so such semi-permanent adjustments mentioned above are unusable. If the settings are to be made frequently, then they must be done simply and quickly which is difficult as the adjustment of the actuating means requires that the stop must also be accurately readjusted. Because it is necessary for the eccentrics to rotate freely thereby necessitating some clearance or springiness as in the case of bearings, if rigid stops, such as used in adjusting a web-type press, are not used to rotationally position the eccentrics, there will be a looseness which will allow the printing cylinders to bounce slightly which will be visible in the printing. Wear will obviously increase the looseness. This bouncing of the cylinders is caused by the manner in which they operate. Levers comprise part of a toggle for selectively rotating a first eccentric and an eccentric shaft such that the first eccentric moves against stops which arrest its rotation thus providing exact gap clearance between the blanket cylinder and the master cylinder and thus providing an exact contact pressure. For a significant portion of the revolution of the blanket cylinder and the master cylinder, there is no impression or contact pressure during which time the cylinders tend to move together as there is no resisting force. When the cylinders rotate around to where the printing begins again, an impact occurs which tends to push the cylinders apart. They are eventually restored to their former positions after several reverberations. This ringing of the printing cylinders occurs and is disruptive of proper printing. Additionally, when this occurs between, for instance, the master cylinder and the blanket cylinder, the effect will be felt at the image transfer point between the blanket cylinder and the impression cylinder. It is an effect commonly referred to as streaking.

Although it is not possible to totally eliminate this effect, it may be minimized to an acceptable level if the blanket cylinder throw-off controls are designed to be very rigid and the forces which restrain the eccentrics are caused to be directed in essentially the same direction as the impression forces and to be several times as great in magnitude. These forces consist of the force to move the sleeve toggle that causes the first eccentric movement of the blanket cylinder and the resisting force from the stop mechanism. The vector sum of these two forces must be greater than and fall between the force vector of the contact between the master cylinder and blanket cylinder and between the blanket cylinder and the impression cylinder. In such case, even though a certain amount of looseness is required to allow for the eccentrics be free to turn, the eccentrics are pressed against their mounts in essentially the same direction as the impression pressures and any tendency for the eccentrics to move within their mounts is virtually eliminated. Thus, it is seen that the adjustment of the eccentric actuating means and the adjustment of the stop require a balancing of forces. If the stop force is too great, the toggle lever cannot be locked and, if it is too little, the eccentric actuating means will be loose and there will be streaking and slurring of the printed image. On presses where impression pressure adjustments are seldom made, as in the web-type press, this manual adjustment can readily be accommodated. However, on presses requiring frequent changes in paper and plate thickness, protracted adjustment procedures are undesirable.

In the present invention, a sleeve actuator is mounted in the frame side walls of the printing mechanism to cause the blanket cylinder to move eccentrically into and out of pressure contact with the master cylinder. A stub shaft is eccentrically mounted in the sleeve and rotatably holds the blanket cylinder. The stub shaft is rotated to cause the blanket cylinder to move eccentrically into and out of pressure contact with the impression cylinder. Pneumatic cylinders are connected to levers which comprise part of a toggle for selectively rotating the sleeve actuator and the eccentric stub shaft. The sleeve moves against stops which arrest its rotation, thus providing an exact gap between the blanket cylinder and the master cylinder and causing an exact impression pressure. The toggle lever for moving the sleeve and thus the blanket cylinder into and out of pressure contact with the master cylinder is mounted on an eccentric bushing. The eccentric bushing is rotatably adjustable to change the pivot point of the toggle lever, which changes the amount of movement of the sleeve actuator and thus the amount of movement of the blanket cylinder toward and away from the master cylinder. In this manner, the contact pressure is adjusted as desired in a simple and efficient manner.

In addition, the pivot point of the second toggle lever which rotates the eccentric stub shaft is also adjustable so that the amount of rotation of the stub shaft can be changed, thus changing the amount of movement of the blanket cylinder towards and away from the impression cylinder to maintain a constant or predetermined contact pressure.

In addition, the stop for the sleeve actuator is mounted on the sleeve itself and a cam is mounted on the shaft for rotatably adjusting the eccentric bushing. An arm is pivotally mounted for connection between the cam and the stop so that when the pivot point of the toggle lever moving the sleeve is adjusted by rotating the eccentric bushing, the cam is also adjusted so that the contact of the stop with the arm is simultaneously adjusted. Thus, adjustment of the toggle link is automatically coordinated with an adjustment of the stop. The throw-off toggle levers are designed to be very rigid and cause the forces which restrain the eccentrics to be directed in essentially the same direction as the impression forces and several times as great in magnitude. Therefore, any tendency for the blanket cylinder to bounce against either the master cylinder or the impression cylinder is minimized, thus minimizing streaking and slurring of the printed image.

In the present invention, when a two-color offset printing machine is utilized, the first adjustment arms for each of the toggle levers that move the sleeve actuators are coupled by a first rod to each other. The rod is threadedly attached at each end to the first adjustment arms and has a wheel rotatably attached to the rod for rotating the rod. Thus, rotation of the rod in a first direction moves the first adjustment arms of each of the sleeve actuators in opposite directions to simultaneously adjust the pivot points of the toggle levers of each of the sleeves, thus simultaneously adjusting the contact pressure between each of the blanket cylinders and its corresponding master cylinder. A digital counter is coupled to the rod such that rotation of the rod in either direction causes the counter to change its count to provide an indication of the movement of each of the first adjustment arms by rotation of the rod.

A second rod is coupled to each of the second adjustment arms for the eccentric stub shafts such that rotation of the rod in either direction causes the second adjustment arms to move simultaneously to change the rotation of the eccentric stub shafts and thereby change the movement of the blanket cylinder toward and away from the impression cylinder to maintain a substantially constant contact pressure. Again, a digital counter is coupled to the second rod to digitally indicate the amount of movement of the second adjustment arms and thus indicate the change in contact pressure between each blanket cylinder and the impression cylinder.

Thus, one of the objects of the present invention is to provide an offset printing machine in which the blanket cylinder moves eccentrically about a first pivot point to contact the master cylinder and eccentrically about a second pivot point to contact the impression cylinder and wherein each of the first and second pivot points is easily adjustable to maintain a predetermined contact pressure between the blanket cylinder and the master cylinder and between the blanket cylinder and the impression cylinder.

It is also an object of the present invention to change the contact pressure between the blanket cylinder and the master cylinder by rotating a first rod in first and second directions.

It is yet another object of the present invention to change the contact pressure between the blanket cylinder and the master cylinder by rotating a first adjustment arm to change the pivot point of a toggle lever that moves the sleeve actuator to adjust the first pivot point about which the blanket cylinder moves eccentrically.

It is also an object of the present invention to provide a rigid stop mechanism for limiting the movement of the blanket cylinder toward the master cylinder.

It is still another object of the present invention to automatically adjust the rigid stop whenever the first pivot point is adjusted so as to maintain the desired contact pressure between the blanket cylinder and the master cylinder.

It is also an object of the present invention to provide a digital counter for digitally indicating the amount of adjustment of the first pivot point and thus the movement of the blanket cylinder toward and away from the master cylinder.

It is yet another object of the present invention to provide a second adjustment arm coupled to an eccentric stub shaft to adjust the second pivot point of the blanket cylinder thereby adjusting the amount of movement of the blanket cylinder toward and away from the impression cylinder.

It is also an object of the present invention to provide a second rotatable rod coupled to the second adjustment arm for moving the second pivot point by adjusting the pivot point of a second toggle lever that rotates the eccentric stub shaft, thereby changing the amount of movement of the blanket cylinder toward and away from the impression cylinder.

It is still another object of the present invention to provide an adjustment wheel coupled to the second rotatable shaft to vary the amount of movement of the second adjustment arm and thus adjust the amount of movement of the blanket cylinder toward and away from the impression cylinder.

It is yet another object of the present invention to provide a second digital counter that is coupled to the second rotatable rod to digitally indicate the amount of movement of the second adjustment arm and thus indicate the relative change in movement of the blanket cylinder toward and away from the impression cylinder.

It is also an object of the present invention to provide a multi-color offset printing machine which has a first rod for simultaneously adjusting the first pivot points of both blanket cylinders simultaneously to adjust the pressure contact simultaneously between each of the blanket cylinders and their respective master cylinders.

It is also an object of the present invention to provide a multi-color offset printing machine having a second rod simultaneously adjusting the second pivot point of both of the blanket cylinders to simultaneously adjust the amount of movement of each blanket cylinder toward and away from the impression cylinder.

It is still another object of the present invention to coordinate the adjustment of the impression forces with the automatic adjustment of a rigid stop mechanism to cause a resultant force vector to be greater than and fall between the force vector representing the contact pressure between the master cylinder and the blanket cylinder and the contact pressure between the impression cylinder and the blanket cylinder to essentially eliminate the tendency for the eccentrics to move in their mounts.

SUMMARY OF THE INVENTION

Thus, the present invention relates to an offset printing machine comprising laterally spaced vertical frame walls, a fixed master cylinder rotatably mounted between the walls for carrying a plate with a transferable image thereon, a fixed impression cylinder rotatably mounted between the walls for carrying paper thereon for receiving the image, a blanket cylinder rotatably mounted between the walls for eccentric movement about a first pivot point to make pressure contact with the master cylinder for receiving the image and for subsequent eccentric movement about a second pivot point for making pressure contact with the impression cylinder to transfer the image to the paper, and means coupled to the blanket cylinder for independently and selectively adjusting the first and second pivot points so as to maintain a first predetermined desired contact pressure between the blanket cylinder and the master cylinder and to maintain a second predetermined contact pressure between the blanket cylinder and the impression cylinder.

The invention also relates to an offset printing machine in which the vector forces for moving a blanket cylinder about a first pivot point to cause a contact pressure between the blanket cylinder and a master cylinder and the vector force caused by a rigid stop are such that the vector sum of those forces lies between and is greater than the contact pressure force vector between the blanket cylinder and the master cylinder and the contact pressure force vector between the blanket cylinder and the impression cylinder, thereby tending to maintain a desired contact pressure between the blanket cylinder and the master cylinder and between the blanket cylinder and the impression cylinder and to eliminate bouncing of the cylinders with respect to each other.

The invention also relates to a multi-color offset printing machine comprising laterally spaced vertical frame walls, a fixed impression cylinder rotatably mounted between the frame walls for carrying paper for receiving first and second colored images thereon, first and second fixed master cylinders, one on each side of the impression cylinder, rotatably mounted between the frame walls and each for carrying a plate with a different colored image thereon, first and second moveable blanket cylinders, one on each side of the impression cylinder, rotatably mounted between the vertical frame walls for contactable relationship with the impression cylinder and a corresponding master cylinder, each of the first and second blanket cylinders being eccentrically moveable about a first pivot point to make a predetermined pressure contact with its corresponding master cylinder for receiving the colored image and subsequently eccentrically moveable about a second pivot point to make a predetermined pressure contact with the impression cylinder to transfer the image to the paper, first means coupled to both blanket cylinders for selectively and simultaneously adjusting the first pivot point to change the eccentric movement of each blanket cylinder so as to maintain a first predetermined contact pressure force vector between the blanket cylinder and the master cylinder, and second means coupled to both blanket cylinders for selectively and simultaneously adjusting the second pivot point to change the eccentric movement of each blanket cylinder so as to maintain a second predetermined contact pressure force vector between the blanket cylinder and the impression cylinder.

BRIEF DESCRIPTION OF THE DRAWINGS

These and other objects of the present invention will be more clearly understood in conjunction with the following detailed description taken in conjunction with the accompanying drawings in which like numerals represent like elements and in which.

DETAILED DESCRIPTION OF THE DRAWINGS

While the following description is set forth in relation to a two-color printing machine for ease of description, the invention is not so limited and the technical concept of the invention may be applied to conventional single-color printing machines as well as multi-color printing machines.

Figure 1:
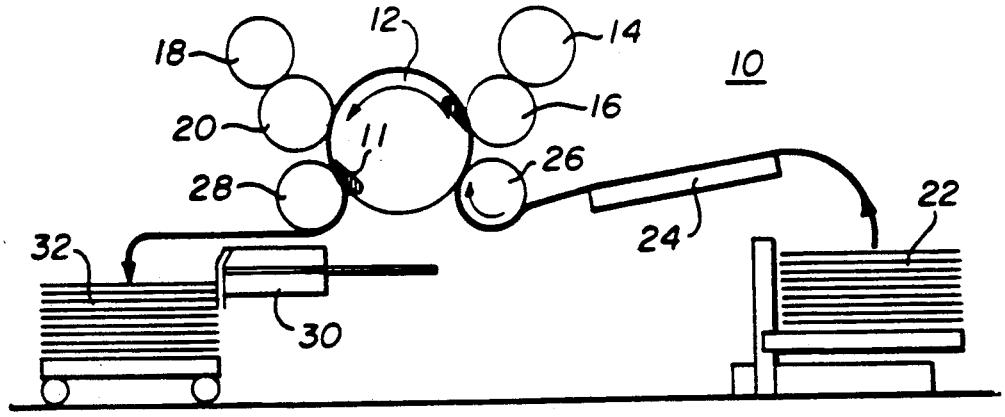
FIG. 1 is general diagrammatic representation of an offset printing machine including a common impression cylinder, two master cylinders and two blanket cylinders.

A two-color offset press or printing machine 10 is illustrated in FIG. 1. Paper sheets from paper stack 22 are picked up in any well-known manner such as by sucker tubes (not shown) and are conveyed to a paper feed conveyor 24 to a transfer cylinder 26. The paper stops and registers and then the transfer cylinder 26 grips the paper and transfers it to the impression cylinder 12 that also has grippers thereon to pick up the sheets. A system for transferring one ink to apply a first color image to the sheet includes an offset blanket cylinder 16 and master cylinder 14, and another system for transferring another ink to apply a second color image to the sheet includes a second blanket cylinder 20 and master cylinder 18.

At the beginning of the operation of the machine 10, the system requires that the image transmitting surfaces on the blanket cylinders 16 and 20 be suitably inked in order to print an acceptable image on the initial sheet of paper on the impression cylinder 12 as it passes through the machine. Accordingly, before the blanket cylinders 16 and 20 contact the sheet of paper on the impression cylinder 12, it is desirable that each be inked. Thus, the surfaces of the blanket cylinders 16 and 20 are brought into contact with the surfaces of the respective master cylinders 14 and 18, respectively, while being separated from the surface of the impression cylinder 12. Once the surfaces of the blanket cylinders 16 and 20 are inked, they are brought into contact successively with the sheet of paper on the impression cylinder 12. The sheet of paper then passes through delivery cylinder 28 along paper path 30 to the receiving stack 32. It is well known that each master cylinder 14 and 18 has a cylinder gap to carry a clamp for mounting the plate. Because the gap mechanism is well known in the art, it is not shown here. In addition, each of the blanket cylinders 16 and 20 also has a gap mechanism for carrying a clamp to hold the blanket on the cylinder. This gap mechanism is not shown because it is also well known in the art. Each of these gap mechanisms is always lower than the surface of the cylinder itself. Thus, each time the gap encounters an adjacent cylinder, no force is applied between the cylinders. On the impression cylinder 12, there are two gap mechanisms because it is a double-sided cylinder and the grippers are located in the gaps. These gaps are not shown in the drawings because they are also well known in the art. When a gap on the impression cylinder 12 is adjacent a gap on one of the blanket cylinders 16 or 20, there is no contact between rubber blanket and the impression cylinder. Thus, during the gap event between the impression cylinder 12 and either of the blanket cylinders 16 and 20, which is for a duration of approximately 60°, there is a cylinder loading pressure $P_1$ between each of the master cylinders 14 and 18 and the corresponding blanket cylinders 16 and 20. In like manner, during correspondence of the gaps between the master cylinders 14 and 18 and their respective blanket cylinders 16 and 20, there is a cylinder loading pressure between the impression cylinder 12 and the blanket cylinders 16 and 20. Thus, for a duration of 60°, there is a pressure load between the impression cylinder 12 and the corresponding blanket cylinders 16 and 20, and for another 60°, there is a pressure load between the master cylinders 14 and 18 and their corresponding blanket cylinders 16 and 20. For the remainder of the cycle, there is a pressure load occurring between both the impression cylinder 12 and the corresponding blanket cylinders 16 and 20 and between the master cylinders 14 and 18 and the corresponding blanket cylinders 16 and 20.

Figure 2:
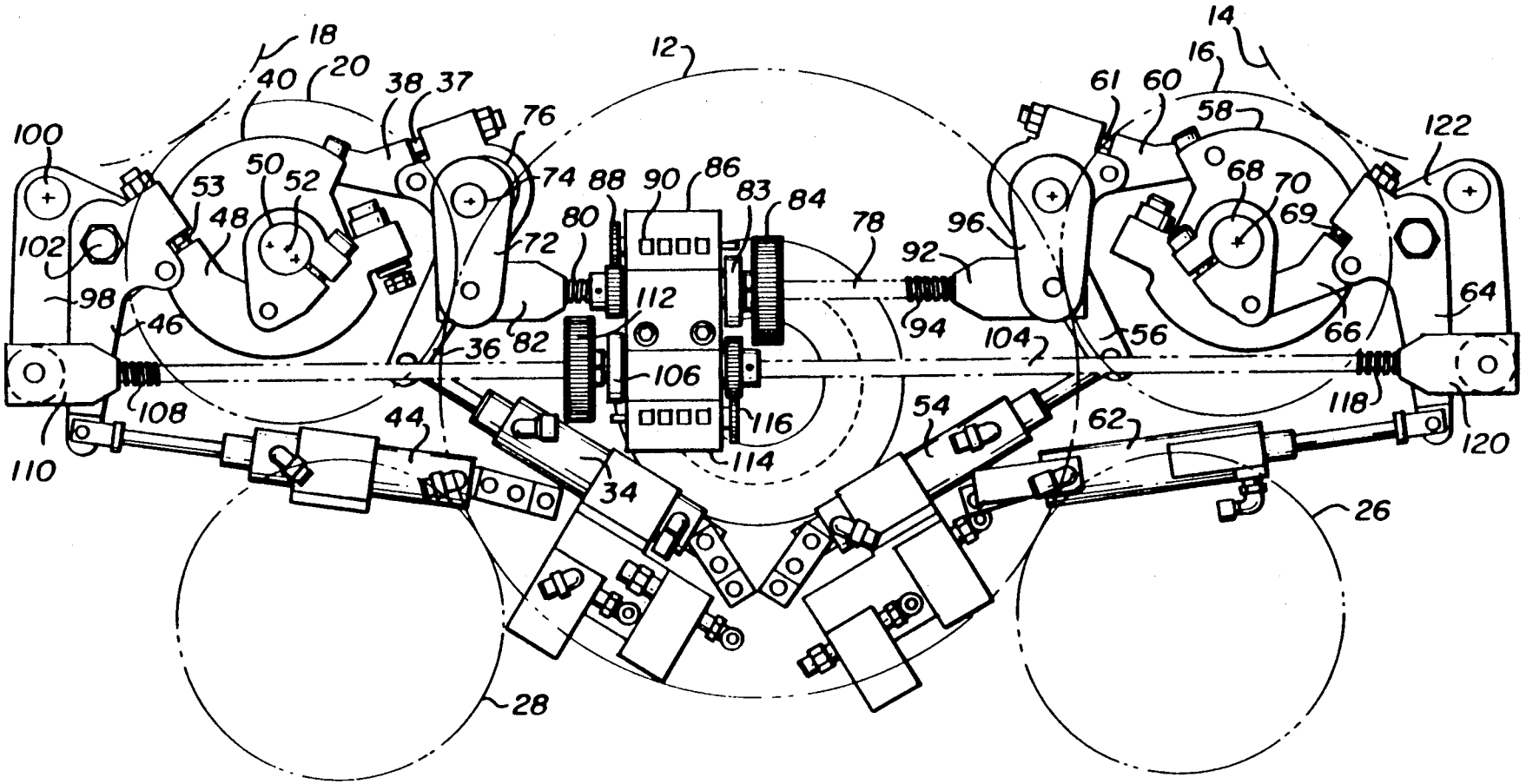
FIG. 2 is a general diagrammatic representation of the novel printing machine of the present invention illustrating the blanket cylinder/master cylinder adjustment mechanism and the blanket cylinder/impression cylinder adjustment mechanism.

FIG. 2 is a diagrammatic representation of the mechanism necessary to bring the blanket cylinders 16 and 20 into and out of correspondence with their respective master cylinder 14 and 18 and the impression cylinder 12. Thus, when air cylinder 34 moves first toggle lever 36 to the position shown, it causes linkage 38 to move sleeve 40 in a counterclockwise rotational direction about a first pivot point 42 (shown in FIG. 3A) thus causing the blanket cylinder 20 to move into contact with master cylinder 18 so that blanket cylinder 20 may be inked. The counterclockwise rotational movement of toggle lever 36 and sleeve 40 continues until it is stopped by engagement of stop member 37 with linkage 38. Stop member 37 is threadably interconnected with lever 36 and moves therewith until it contacts linkage 38. After stop 37 engages linkage 38, further movement of both sleeve 40 and lever 36 is arrested thus providing a positive stop element therefor.

Then when the blanket cylinder 20 has been inked, second air cylinder 44 moves second toggle lever 46 clockwise to cause linkage 48 to rotate eccentric shaft stub 50 clockwise about its centerline 52. This clockwise movement of toggle lever 46 and shaft stub 50 continues until it is stopped by engagement of stop member 53 with linkage 48. Stop member 53 is threadably interconnected with lever 46 and moves therewith until it contacts linkage 48. After stop 53 engages linkage 48, further movement of both shaft 50 and lever 46 is arrested thus providing a positive stop element therefor.

In like manner, on the other side of the machine, air cylinder 54 moves toggle lever 56 to rotate sleeve 58 through linkage 60 to move the blanket cylinder 16 into contact with the master cylinder 14 and stop member 61 acts to stop such rotary movement of toggle lever 56 and sleeve 58. Subsequently, air cylinder 62 moves toggle lever 64 counterclockwise to cause linkage 66 to rotate eccentric shaft stub 68 about centerline 70 causing the blanket cylinder 16 to move into contact with the impression cylinder 12. Counterclockwise movement of lever 64 and shaft stub 68 continues until it is stopped by engagement of stop member 69 with linkage 66. Stop member 69 is threadably interconnected with lever 64 and moves therewith until it contacts linkage 66. After stop 69 engages linkage 66, further movement of both shaft stub 68 and lever 64 is arrested thus providing a positive stop element therefor.

Clearly, a predetermined amount of contact pressure is desired between the blanket cylinders 16 and 20 and the respective master cylinders 14 and 18 and between the blanket cylinders 16 and 20 and the impression cylinder 12. Adjustment, however, must be made for normal wear, thickness of plates, thickness of blankets, and paper stock used. A first mechanism is utilized to adjust the amount of eccentric movement of each of the blanket cylinders 16 and 20 about a first pivot point toward or away from the respective master cylinders 14 and 18. Since they are identical, only one of the mechanisms will be described in detail. A first adjustment arm 72 is rigidly attached to a sleeve adjustment shaft 74. Mounted on that same shaft 74 is an eccentric bushing 76 on which the first toggle lever 36 is pivotally mounted. Thus, if the first adjustment arm 72 is moved in either direction so as to rotate sleeve adjustment shaft 74, the eccentric bushing 76 is also rotated which moves the pivot point of the first toggle lever 36. The movement of the first toggle lever 36 pivot point changes the amount of rotation of the sleeve 40, thus moving the blanket cylinder 20 towards the master cylinder 18. This will be shown in more detail in relation to FIG. 3B.

A master/blanket cylinder adjustment rod 78 is coupled by threads 80 to a plate 82 that is pivotally attached to the first adjustment arm 72. The rod 78 is mounted to the machine 10 by threaded sleeve 83. Rotation of sleeve 83 causes axial displacement of rod 78 whereby adjustment arms 72 and 96 are complementarily biased into adjustment. Furthermore, by rotating knurled wheel 84, rigidly attached to rod 78, the rod 78 is rotated causing the threads 80 to move the plate 82 towards or away from the knurled wheel 84, thereby moving the first adjustment arm 72. A digital counter 86 is coupled through gears 88 to the rod 78 to give a digital indication in windows 90 of the amount of rotation of rod 78 and thus giving an indication of the amount of movement of blanket cylinder 20 towards or away from the master cylinder 18. The rod 78 is coupled to the other side of the machine 10 to plate 92 through threads 94 to move second adjustment arm 96 in a like manner as described previously with respect to first adjustment arm 72. The threads 80 and 94 are reverse threads; thus, for instance, the threads 80 may be right-handed threads while the threads 94 may be left-handed threads. By such construction, rotational movement of the rod 78 through knurled wheel 84 will cause the proper adjustment to be made simultaneously to both of the blanket cylinders 16 and 20 with respect to the master cylinders 14 and 18, respectively.

The adjustment of the contact pressure between the blanket cylinders 16 and 20 with respect to impression cylinder 12 is controlled by a separate mechanism. Thus, triangular plate 98 is pivotally attached to the machine 10 at pivot point 100. The second toggle lever 46 is pivotally attached to the triangular plate 98 by a bolt at pivot point 102. When the triangular plate 98 is moved or rotated about the point 100, the pivot point 102 of second toggle lever 46 is also moved which changes the amount of rotation of eccentric stub shaft 50 when the toggle lever 46 is rotated. Thus, the amount of movement of the blanket cylinder 20 towards or away from impression cylinder 12 can be adjusted by moving the triangular plate 98. To accomplish that purpose, a second rod 104 is attached to the machine 10 by brackets 106. It is coupled by threads 108 to plate 110 that is pivotally attached to triangular plate 98. A second knurled wheel 112 is rigidly attached to rod 104 for enabling the rod 104 to be rotated. When it is rotated, the threads 108 cause plate 110 to move towards or away from the knurled wheel 112, thus moving triangular plate 98 about pivot point 100 and thereby changing the pivot point 102 of the second toggle lever 46 to adjust the amount of movement of the blanket cylinder 20 towards or away from the impression cylinder 12. Again, a digital counter 114 is coupled to the shaft 104 through gear train 116 to give a digital indication of the amount of movement of the blanket cylinder 20 towards or away from the impression cylinder 12. As in the case with first rod 78, the second rod 104 is also coupled to the other side of the two-color offset machine to simultaneously adjust the other blanket cylinder 16 with respect to the impression cylinder 12. Thus, the other end of rod 104 has threads 118 coupled to plate 120 to adjust the movement of triangular plate 122 and thereby adjust the movement of the second blanket cylinder 16 towards and away from impression cylinder 12. Clearly then, by rotating knurled wheels 84 and 112, the contact pressure between the blanket cylinders 16 and 20 and their corresponding master cylinders 14 and 18 can be adjusted simultaneously while the contact pressure between the blanket cylinders 16 and 20 and the impression cylinder 12 may be adjusted simultaneously.

Figure 3A:
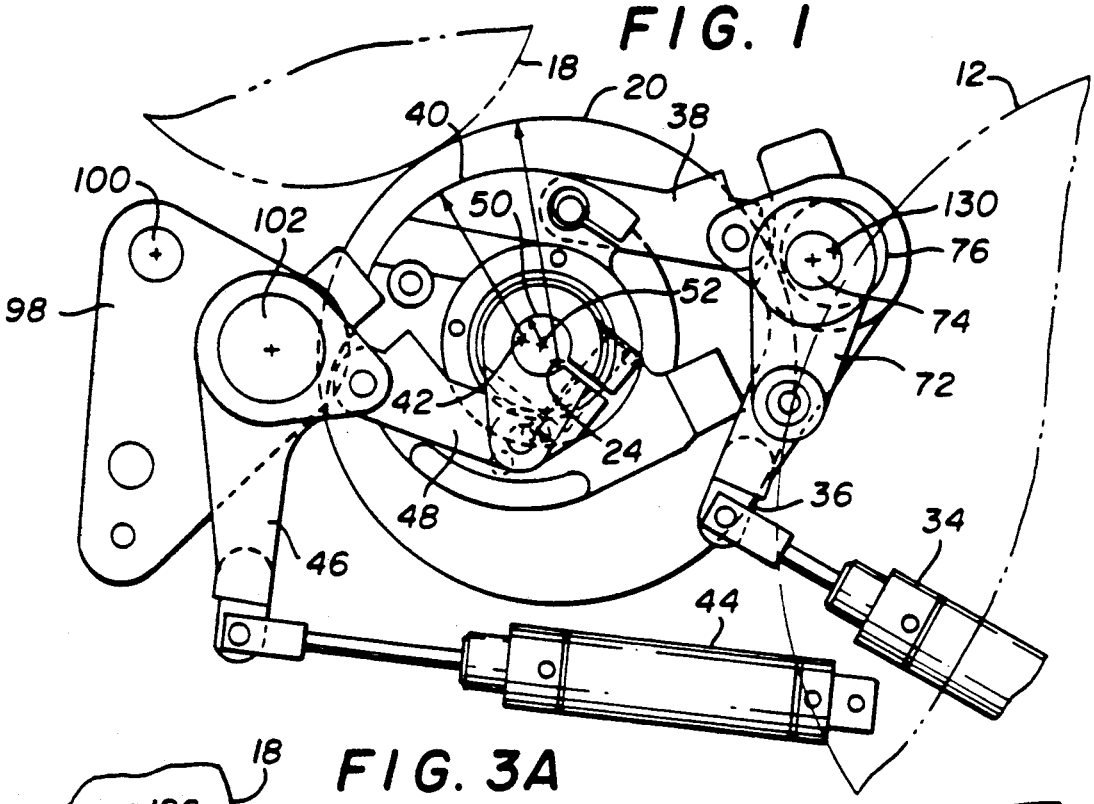
FIG. 3A is a detailed drawing of the adjustment mechanism for both the first pivot point for the blanket cylinder/master cylinder adjustment and the second pivot point for the blanket cylinder/impression cylinder adjustment.
Figure 3B:
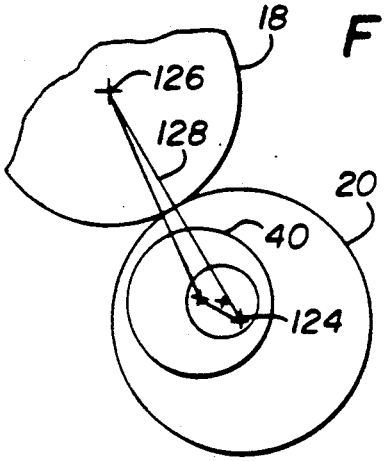
FIG. 3B is an illustration of the manner in which adjustment of the sleeve actuator adjusts the eccentric movement of the blanket cylinder toward and away from the master cylinder.
Figure 3C:
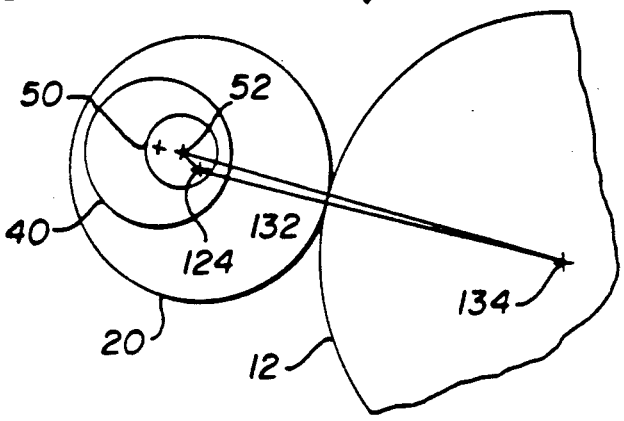
FIG. 3C diagrammatically illustrates the manner in which adjustment of the eccentric stub shaft adjusts movement of the blanket cylinder toward and away from the impression cylinder.

FIG. 3A is a detailed diagram of the mechanism for adjusting blanket cylinder 20 with respect to master cylinder 18 and impression cylinder 12. As can be seen in FIG. 3A, the blanket cylinder 20 rotates about axis 124. The sleeve actuator 40 rotates about centerline 42. Finally, the eccentrically mounted shaft stub 50 rotates about centerline 52. Thus, each of the axes 42, 52 and 124 is eccentric with respect to the other. As can be seen more clearly in FIG. 3B, if the sleeve 40 is rotated counterclockwise, the line 128 connecting the rotational axis 124 of blanket cylinder 20 and the rotational axis 126 of master cylinder 18 becomes shorter. Thus, the blanket cylinder 20 is moved eccentrically towards the master cylinder 18. In like manner, if the sleeve 40 is rotated clockwise in FIG. 3B, the rotational axis 124 of blanket cylinder 20 tends to move further away from the rotational axis 126 of the master cylinder 18, thus causing the blanket cylinder 20 to move eccentrically away from master cylinder 18. Thus as can be seen in FIG. 3A, sleeve 40 is rotated clockwise or counterclockwise by a movement of toggle lever 36 by air cylinder 34. When first adjustment arm 72 is moved in a counterclockwise direction by rod 78, the eccentric bushing 76 has its centerline 130 moved in a counterclockwise direction, thus moving the linkage 38 and rotating the eccentric bushing 40 in a counterclockwise direction. Thus movement of the shaft 74 through adjustment arm 72 will adjust the movement of the blanket cylinder 20 towards and away from the master cylinder 18. In like manner, as can be seen in FIG. 3C, when the eccentric stub shaft 50 is rotated counterclockwise, it causes the centerline 124 of the blanket cylinder 20 to move counterclockwise, thus shortening the line 132 coupling the centerline 124 of the blanket cylinder 20 and centerline 134 of the impression cylinder 12, thus eccentrically moving the blanket cylinder 20 toward the impression cylinder 12. Also, if the eccentric shaft stub 50 is rotated clockwise, it tends to move the centerline 124 of blanket cylinder 20 in a clockwise direction, thus lengthening line 132 connecting the centerline 124 of blanket cylinder 20 and the centerline 134 of impression cylinder 12, thus eccentrically moving the blanket cylinder 20 away from the impression cylinder 12. Considering FIG. 3A, when triangular plate 98 is moved counterclockwise about pivot point 100, the pivot point 102 of toggle lever 46 is moved counterclockwise, thus tending to rotate eccentric shaft stub 50 counterclockwise and eccentrically move blanket cylinder 20 toward impression cylinder 12.

Considering now FIG. 3A, if triangular plate 98 is rotated clockwise about pivot point 100, pivot point 102 of toggle arm 46 is also moving in a clockwise direction tending to rotate eccentric shaft stub 50 in the clockwise direction. According to the diagram illustrated in FIG. 3C, such rotation will tend to move the blanket cylinder 20 away from the impression cylinder 12.

Figure 4A:
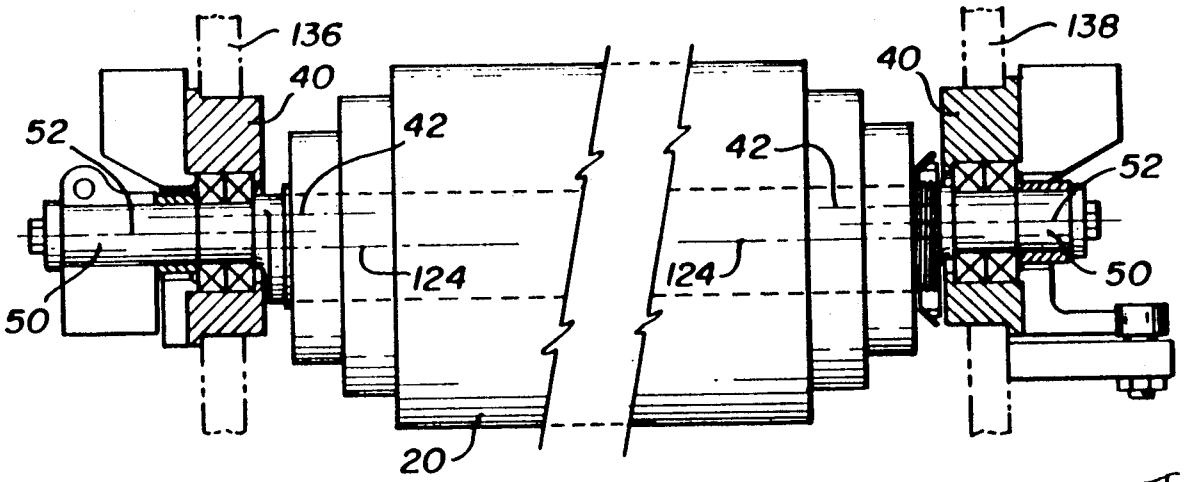
FIG. 4A is a diagrammatic representation of the blanket cylinder eccentrically mounted on the stub shaft which is eccentrically mounted on the sleeve actuators which are mounted in the vertical frame walls of the machine.
Figure 4B:
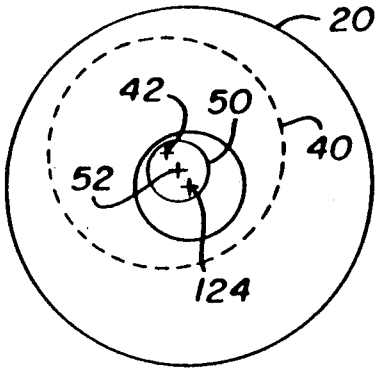
FIG. 4B is a diagrammatic representation of the end view of the device in FIG. 4A illustrating the relationship of the axis of the sleeve actuator, the axis of the eccentric stub shaft, and the axis of the blanket cylinder.

FIG. 4A is a diagrammatic representation of the blanket cylinder 20 and its relationship to the eccentric shaft stub 50 and the sleeve actuator 40. As can be seen in FIG. 4A, the sleeves 40 are mounted in vertical side walls 136 and 138 for rotation about axis 42 therein. An eccentric stub shaft 50 is mounted eccentrically for rotation about centerline 52 in each of the sleeves 40. The eccentric stub shaft 50 enables the blanket cylinder 20 to be eccentrically mounted therein about axis 124. Thus as can be seen in FIG. 4B, rotation of the sleeves 40 about their centerline 42 eccentrically moves the blanket cylinder 20 and its centerline 124 about centerline 42. In like manner, rotation of the eccentric stub shaft 50 about its centerline 52 also eccentrically moves the blanket cylinder 20 and its centerline 124 about centerline 52. Because of the geometric relationship of the centerlines 42, 52 and 124, rotation of the sleeve 40 in a counterclockwise direction moves the centerline of blanket cylinder 20 towards its corresponding master cylinder 18, as explained earlier, while clockwise rotation of the eccentric stub shaft 50 moves the blanket cylinder 20 and its centerline 124 in a clockwise direction to move blanket cylinder eccentrically away from the impression cylinder 12. Thus with the mechanism illustrated in FIGS. 4A and 4B, each blanket cylinder can be adjusted with respect to its associated master cylinder to compensate for wear, thickness of plates and thickness of blankets. In like manner, the mechanism shown in FIGS. 4A and 4B can also adjust blanket cylinder 20 with respect to impression cylinder 12 to compensate for wear, paper stock used and thickness of blankets.

Figure 5:
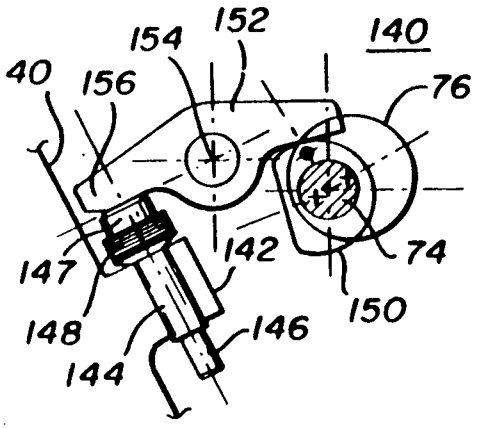
FIG. 5 illustrates the adjustable stop mechanism whereby adjustment of the pivot point of the sleeve actuator also adjusts the stop mechanism simultaneously.

In order to provide an exact gap between the blanket cylinder 20 and the plate cylinder 18 (and blanket cylinder 16 and its respective master cylinder 14), the corresponding sleeves 40 and 58 (in FIG. 2) must move against a respective stop mechanism to arrest their rotation. The entire stop mechanism 140 is shown in conjunction with the other elements in FIG. 8. However, the details are illustrated in FIG. 5. A mount 142 is integrally formed with the sleeve 40. A bolt 146 having a head 147 is inserted in an orifice 144 in mount 142. Springs 148, such as well-known Belleville washers, are inserted on the bolt between the bolt head 147 and the mount 142. A cam 150 is mounted on sleeve adjustment shaft 74 where the eccentric bushing 76 is mounted. An arm 152 pivoting about shaft 154 couples the cam 150 and the bolt head 147. Whenever toggle arm 36, shown in FIG. 3A, is moved in a counterclockwise direction about eccentric bushing 76 and sleeve 40 is rotated counterclockwise, the mount 144 is also moved counterclockwise bringing the bolt head 147 into contact with the end 156 of arm 152, thus stopping rotation of the sleeve 40. End 156 of arm 152 bears on the bolt head 147, thus causing it to compress the springs or Belleville washers 148. The purpose of the springs or Belleville washers 148 is to maintain a constant force, thus compensating for manufacturing tolerances and deficiencies. If, however, the adjustment arm 72 in FIG. 3A is moved to rotate shaft 74 and change the pivot point of toggle lever 36 by moving eccentric bushing 76, the rotational position of the sleeve 40 is then changed and the stop mechanism 140 would normally have to be manually readjusted. However, in this case, the problem is overcome by rigidly attaching cam 150 to shaft 74 so that when shaft 74 is rotated, the cam 150 moves pivotal arm 152 to compensate for the movement of the sleeve 40. Thus, the same stop pressure is maintained by having cam 150 readjust the position of the end 156 of arm 152 to contact bolt head 147 at a different point. Accordingly, the same force vector is maintained regardless of the rotational adjustment of the sleeve 40.

Figure 6A:
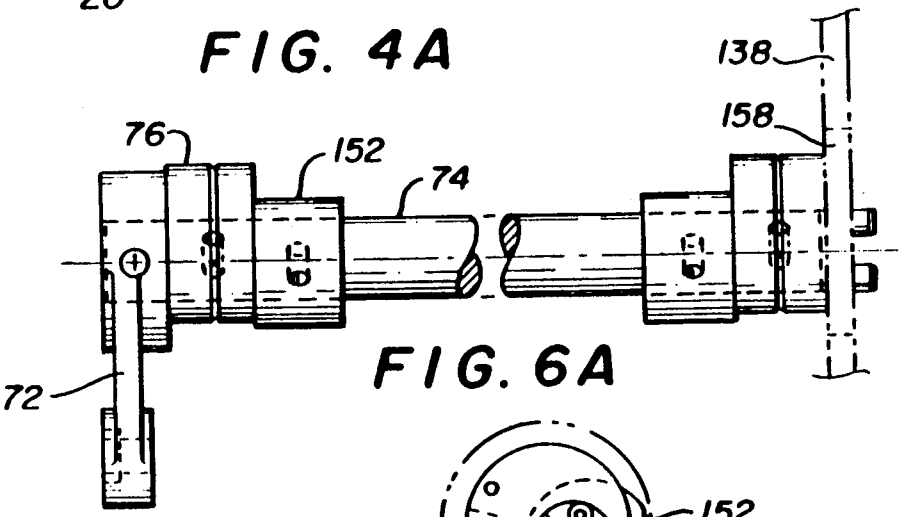
FIG. 6A is a side view of the shaft which adjusts the pivot point of the toggle lever that moves the sleeve actuator and simultaneously adjusts the stop mechanism.
Figure 7:
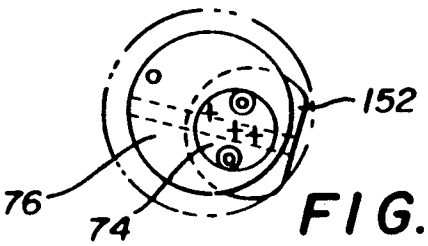
FIG. 7 is a end view of FIG. 6A from the right side thereof.
Figure 6B:
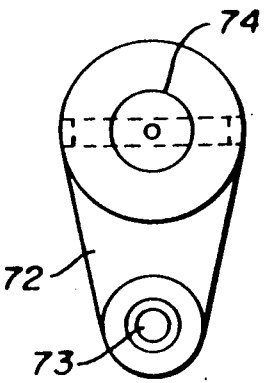
FIG. 6B is an end view of the shaft of FIG. 6A from the left side thereof.

The sleeve adjustment shaft 74, the eccentric bushing 76 the cam 150 and the adjustment arm 172 are shown mounted in bearing 158 in vertical side wall 138 in detail in FIG. 6A. FIG. 6B is an end view from the left end illustrating the pivot point 73 to which the adjustment rod 78, threadedly coupled by threads 80 to plate 82, moves adjustment arm 72 to rotate shaft 74. FIG. 7 is an end view from the right end of FIG. 6A illustrating the bearing 158 mounted in vertical side wall 138 and again illustrating the relationship of cam 150, eccentric bushing 76 and shaft 74.

Figure 8:
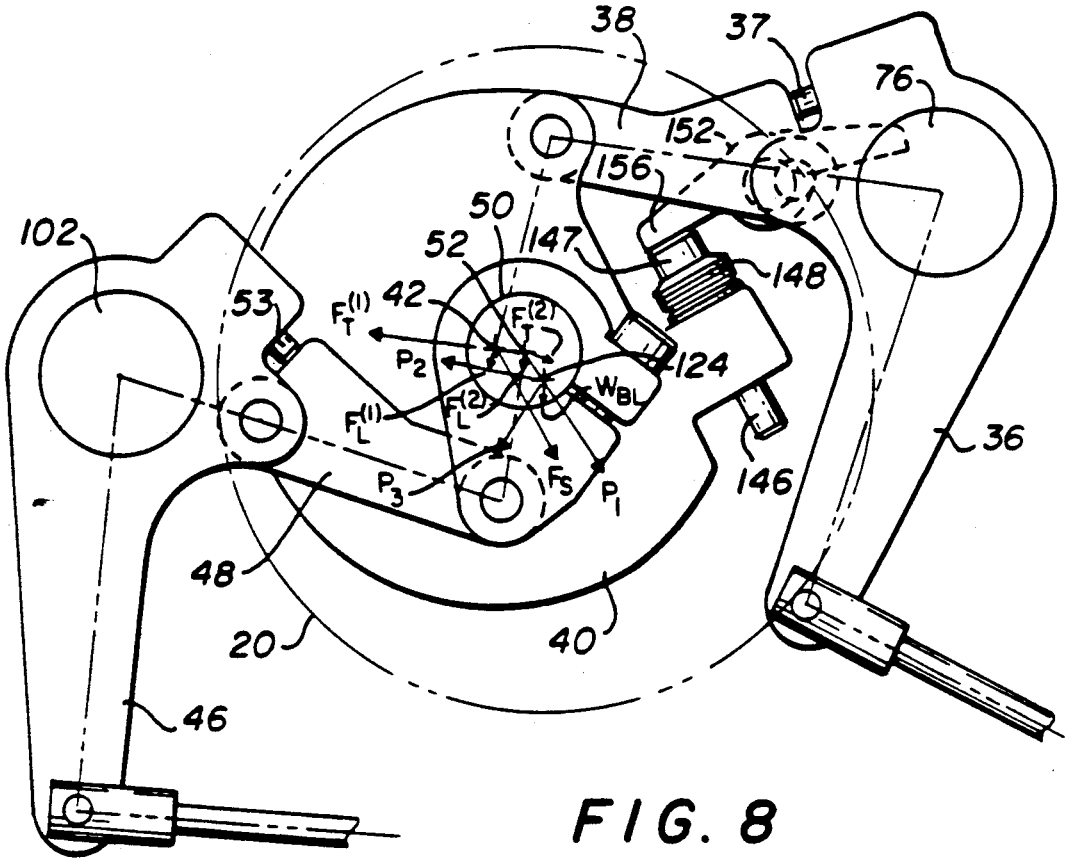
FIG. 8 is a schematic representation of the mechanism for adjusting the first and second pivot points of the blanket cylinder illustrating the forces that are applied about the axis for the sleeve actuator, the axis for the eccentric stub shaft, and the axis for the blanket cylinder.

FIG. 8 is a diagram of one of the blanket cylinder throw-off mechanisms illustrating the various forces that are applied to the sleeve actuator and the eccentric shaft stub during the printing mode. The forces applied at the centerline 42 of the sleeve 40 are $F_r(1)$, the force applied for sleeve rotation; $F_L(1)$, the sleeve toggle arm lock-up force; and $F_s$, the sleeve stop force caused by the stop mechanism. The forces about the centerline 52 of the eccentric shaft stub 50 are $F_L(2)$, and the shaft toggle lock-up force, $F_r(2)$, the force applied during rotation of the eccentric stub shaft 50. The forces occurring about the axis of rotation 124 of the blanket cylinder 20 are $P_1$, the cylinder pressure loading between the master cylinder 18 and the blanket cylinder 20 for a duration of 60° during the gap event between the impression cylinder 12 and the blanket cylinder 20, the force $P_2$, the cylinder pressure loading between the impression cylinder 12 and the blanket cylinder 20 for a duration of 60° during the gap event between the master cylinder 18 and the blanket cylinder 20, and $P_3$, the resultant of the forces $P_1$ and $P_2$ for a duration of240° when no gap event occurs. Further, the force $W_{bl}$, the blanket cylinder weight, is also located at axis 124. Thus, the pressure load vector between the cylinders swings from $P_1$ to $P_2$ or an angle of 135° during operation. The resultant force swing from all of the forces applied from the sleeve 40/eccentric shaft stub 50 to the frame side walls of the machine 10 reduces significantly due to two factors: (1) the toggle lock-up forces $F_L(1)$ and $F_L(2)$ and (2) the sleeve stop force $F_s$.

Figure 9:
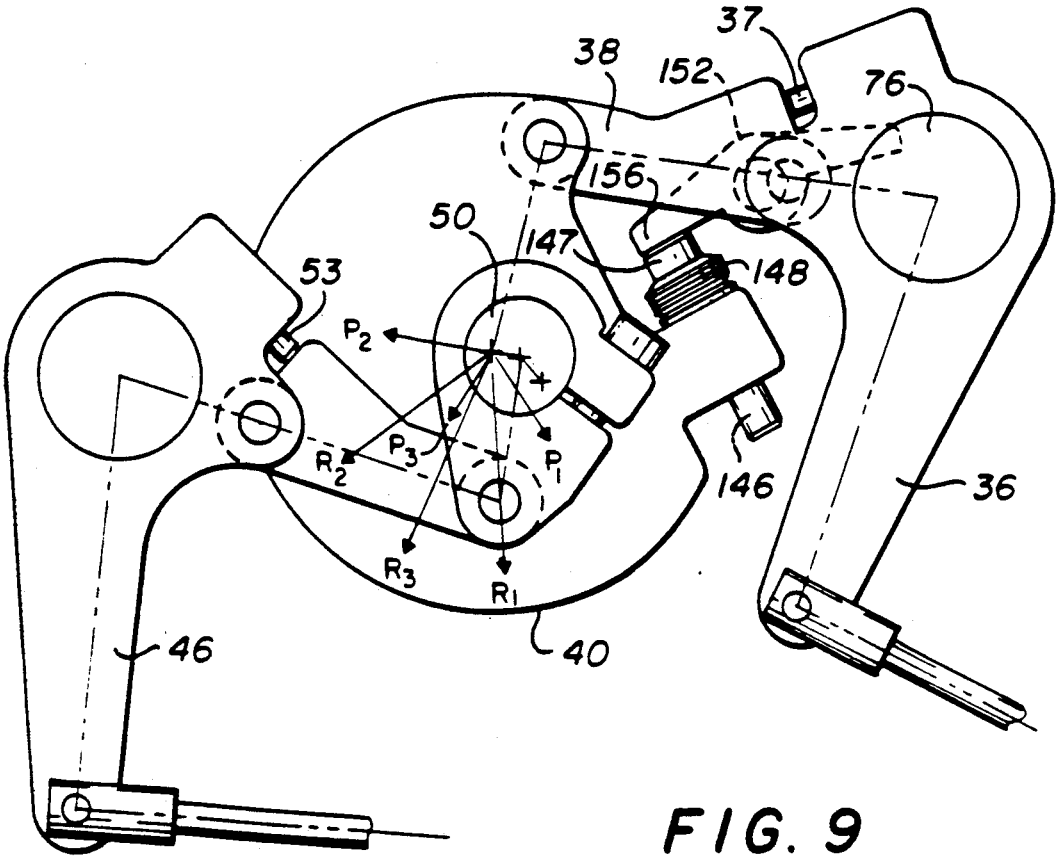
FIG. 9 illustrates the resultant forces at the center of the sleeve actuator to demonstrate the significant reduction of resultant force vector swing and increase of the resultant force vector magnitude during the printing mode as a result of the contact forces between the blanket cylinder and the master cylinder and the blanket cylinder and the impression cylinder.

In FIG. 9, the cylinder pressure loading conditions $P_1$, $P_2$ and $P_3$ are shown at the center of the sleeve 40 to demonstrate the resulting forces $R_1$, $R_2$ and $R_3$ that are applied from the sleeve/eccentric shaft stub assembly to the frame for loading conditions $P_1$, $P_2$ and $P_3$, respectively. It can be seen that there is a significant reduction of force vector swing angle between $R_1$ and $R_2$ during the printing mode as a result of the sleeve stop and the toggle lock-up design.

Thus, there has been disclosed an improved cylinder setting mechanism for either a single or two-color offset press that moves the blanket cylinder into and out of pressure contact with the master cylinder about a first pivot point and subsequently for eccentrically moving the blanket cylinder into and out of pressure contact with the impression cylinder about a second pivot point so that the blanket cylinder can be inked prior to transferring the image to the paper on the impression cylinder. The improvement comprises a simplified control to provide independent adjustment of each of the first and second pivot points to compensate for wear, varying thickness of plates, blankets and paper stock. Further, the invention comprises a toggle which sets the pressure between the blanket cylinder and the master cylinder to operate against a stop to ensure that there is a predetermined contact pressure between the surfaces of the blanket cylinder and the master cylinder and to automatically adjust the stop commensurate with an adjustment of the toggle for a different thickness blanket so that the desired offset printing pressure between the master and the blanket cylinder surfaces is held at the optimum level.

The foregoing specification describes only the embodiments of the invention shown and/or described. Other embodiments may be articulated as well. The terms and expressions used, therefore, serve only to describe the invention by example and not to limit the invention. It is expected that others will perceive differences which, while different from the foregoing, do not depart from the scope of the invention herein described and claimed. In particular, any of the specific constructional elements described may be replaced by any other known element having equivalent function.

We claim:

1. An offset printing machine comprising:

laterally spaced vertical frame walls;

a fixed master cylinder rotatably mounted between said walls for carrying a transferable image thereon;

a fixed impression cylinder rotatably mounted between said walls for carrying paper thereon for receiving said image;

a blanket cylinder rotatably mounted between said walls for movement about a first pivot point to make pressure contact with the master cylinder for receiving the image and for subsequent movement about a second pivot point for making pressure contact with the impression cylinder to transfer the image to the paper;

means coupled to said blanket cylinder for independently and selectively adjusting the first and second pivot points so as to maintain a first predetermined desired contact pressure between the blanket cylinder and the master cylinder and to maintain a second predetermined contact pressure between the blanket cylinder and the impression cylinder;

a stop mechanism associated with said first pivot point and positioned to allow said blanket cylinder to move toward said master cylinder only a predetermined amount so as to maintain said first predetermined contact pressure; and means coupled to said stop mechanism and said independent and selective adjusting means to change the position of said stop mechanism when the first pivot point is adjusted so as to maintain the first predetermined contact pressure between the blanket cylinder and the master cylinder.

2. An offset printing machine as in claim 1 further comprising:

a sleeve mounted in each of said vertical frame walls in diametrically opposed relationship for rotation about a first axis coupling said first pivot points;

a shaft stub eccentrically mounted in each of said sleeves in diametrically opposed relationship for rotation about a second axis coupling said second pivot points;

a blanket cylinder shaft extending between and rotatably coupled to said eccentric shaft stubs for rotation about a third axis parallel to and eccentric with respect to said first and second axes; and means for sequentially rotating said sleeve and said eccentric shaft stub into two steps to set said blanket cylinder into said pressure contact engagement initially with the master cylinder for receiving an image and subsequently with the impression cylinder to transfer said image to paper.

3. An offset printing machine as in claim 2 wherein said means for rotating said sleeves about first said pivot point further comprises:

a sleeve adjustment shaft coupled to said vertical frame walls;

a first toggle lever rotatably coupled to said sleeve adjustment shaft;

an air cylinder coupled to one end of said first toggle lever for pivoting said first toggle lever about said sleeve adjustment shaft between first and second positions; and a linkage having one end coupled to one of said sleeves and the other end coupled to said first toggle lever such that movement of the first toggle lever between said first and second positions rotates said sleeves about said first pivot point to move said blanket cylinder eccentrically into and out of engagement with said master cylinder.

4. The offset printing machine as in claim 3 further comprising:

an eccentric bearing rigidly mounted to said sleeve adjustment shaft for rotatably receiving said first toggle lever such that rotation of said sleeve adjustment shaft changes the pivot point of said first toggle lever; and a first adjustment arm rigidly coupled to said sleeve adjustment shaft for rotating said sleeve adjustment shaft to position said eccentric bearing and change the pivot point of the first toggle lever and the corresponding amount of rotation of the sleeve so as to change the distance of movement of the blanket cylinder toward the master cylinder for maintaining the predetermined contact pressure between the master cylinder and the blanket cylinder as necessary.

5. The offset printing machine as in claim 4 further including:

a first rod threadedly connected to the first adjustment arm;

a first adjustment wheel coupled to said frame and connected to the first rod for rotating said rod and moving the first adjustment arm in first and second directions to rotate the sleeve adjustment shaft and adjust the contact pressure between the blanket cylinder and the master cylinder; and a first numerical counter coupled to the first rod for numerically registering the amount of movement of said first adjustment arm from a given point.

6. The offset printing machine as in claim 5 further comprising:

a cam rigidly fixed on said sleeve adjustment shaft; and a stop arm pivotally coupled between said cam and the stop mechanism such that rotation of the sleeve by said first toggle lever is limited by the stop mechanism contacting the stop arm and rotation of the sleeve adjustment shaft moves the cam to change the point at which the stop arm contacts the stop mechanism thereby maintaining the desired contact pressure between the blanket cylinder and the master cylinder.

7. The offset printing machine as in claim 6 wherein said stop mechanism further comprises:

a mount on said sleeve;

a bolt slidably attached to the mount, said bolt having a bolt head; and a plurality of compressible springs on said bolt between said bolt head and said mount, said stop arm contacting said bolt head to slide said bolt against and compress the springs so as to maintain a constant pressure and compensate for manufacturing tolerances and deficiencies.

8. The offset printing machine as in claim 7 further comprising:

a second adjustment arm having first, second and third orifices and attached to a side wall with a first one of said orifices;

a second toggle lever coupled to a second one of said orifices of said second adjustment arm as a pivot point for pivotal movement about said second orifice between first and second positions;

a link coupling said second toggle lever to said eccentric stub shaft for rotating said eccentric stub shaft about said second axis when said second toggle lever is moved between said first and second positions to move said blanket cylinder into and out of engagement with the impression cylinder; and an air cylinder coupled to one end of said second toggle lever for selectively pivoting said second toggle lever between said first and second positions to rotate said eccentric stub shaft.

9. The offset printing machine as in claim 8 further including:

a second rod threadedly connected to the third orifice of said second adjustment arm;

a second adjustment wheel coupled to said frame and connected to the second rod for rotating said second rod and moving the second adjustment arm in first and second directions to rotate the second adjustment arm and move the pivot point of said second toggle lever to maintain the contact pressure between the blanket cylinder and the impression cylinder; and a second numerical counter to the second rod for numerically registering the amount of movement of said second adjustment arm from a given point.

10. An offset printing machine comprising:

laterally spaced vertical frame walls;

a fixed master cylinder rotatably mounted between said walls for carrying a transferable image thereon;

a fixed impression cylinder rotatably mounted between said walls for carrying paper thereon for receiving said image;

a blanket cylinder rotatably mounted between said walls for eccentric movement about a first pivot point to make pressure contact with the master cylinder for receiving the image and for subsequent second eccentric movement about a second pivot point for making pressure contact with the impression cylinder to transfer the image to the paper;

a pair of sleeves, each sleeve being mounted in each of said walls for rotation about the first pivot point to cause the first eccentric movement of the blanket cylinder;

first toggle means coupled to at least one of the sleeves for independently and selectively rotating the sleeves about the first pivot point with a force represented by a first force vector to cause the first eccentric movement of the blanket cylinder and provide a predetermined pressure contact between the blanket cylinder and the master cylinder as represented by a second force vector;

a shaft eccentrically mounted in each sleeve for rotation about the second pivot point, said eccentrically mounted shafts rotatably receiving the blanket cylinder about a third common axis eccentric with respect to the first and second pivot points;

second toggle means coupled to at least one of the eccentrically mounted shafts for independently and selectively rotating the shafts about the second pivot point with a force represented by a third force vector to cause the second eccentric movement of the blanket cylinder and provide a predetermined pressure contact between the blanket cylinder and the impression cylinder as represented by a fourth force vector; and a stop mechanism positioned on each of said sleeves for limiting rotation of said first and second toggle means such that rotation of said sleeves about said first pivot point is accomplished by a force represented by a fifth force vector, the vector sum of said first and fifth force vectors lying between the second and fourth force vectors thereby tending to maintain a desired contact pressure between the blanket cylinder and master cylinder and between the blanket cylinder and the impression cylinder.

11. An offset printing machine comprising:

laterally spaced vertical frame walls;

a fixed master cylinder rotatably mounted between said walls for carrying a transferable image thereon;

a fixed impression cylinder rotatably mounted between said walls for carrying paper thereon for receiving said image;

a blanket cylinder rotatably mounted between said walls for eccentric movement about a first pivot point to make pressure contact with the master cylinder for receiving the image and for subsequent eccentric movement about a second pivot point for making pressure contact with the impression cylinder to transfer the image to the paper;

means coupled to said blanket cylinder for independently and selectively rotating the first and second pivot points with first and second force vectors, respectively, so as to cause first and second eccentric movements of the blanket cylinders and maintain first and second respective contact pressures between the blanket cylinder and the master cylinder and between the blanket cylinder and the impression cylinder, said contact pressure represented by third and fourth force vectors, respectively; and stop means associated with said rotating means for limiting rotation of said first pivot point and generating a fifth force vector such that the fifth force vector in conjunction with the first and second force vectors generates a resultant force vector greater than and falling between the third and fourth force vectors thereby tending to maintain a desired contact pressure between the blanket cylinder and the master cylinder and between the blanket cylinder and the impression cylinder.

12. A multi-color offset printing machine comprising:

laterally spaced vertical frame walls;

a fixed impression cylinder rotatably mounted between said frame walls for carrying paper for receiving first and second colored images thereon;

first and second fixed master cylinders, one on each side of said impression cylinder, rotatably mounted between said frame walls and each for carrying a different colored image thereon;

first and second moveable blanket cylinders, one on each side of the impression cylinder, rotatably mounted between the vertical frame walls for contactable relationship with the impression cylinder and a corresponding master cylinder, each of said first and second blanket cylinders being eccentrically moveable about a first pivot point to make pressure contact with its corresponding master cylinder for receiving the colored image and subsequently eccentrically moveable about a second pivot point to make pressure contact with the impression cylinder to transfer the image to the paper;

first means coupled in common to both blanket cylinders for selectively and simultaneously rotating the first pivot point of each blanket cylinder so as to maintain a first predetermined desired contact pressure force vector between the blanket cylinder and the master cylinder; and second means coupled in common to both blanket cylinders for selectively and simultaneously rotating the second pivot point so as to maintain a second predetermined desired contact pressure force vector between the blanket cylinder and the impression cylinder.

13. The offset printing machine as in claim 12 further comprising:

means coupled to the first means for rotating the first pivot print to adjust the amount of rotation of said first pivot point to compensate for a change in the desired contact pressure between the blanket cylinder and the master cylinder;

a stop mechanism associated with said first pivot point of each blanket cylinder and positioned to allow each blanket cylinder to move towards its corresponding master cylinder only a predetermined amount so as to maintain said first predetermined contact pressure; and means coupled to said stop mechanism and said means for adjusting the amount of rotation of said first pivot point to change the position of said stop mechanism when the first pivot point amount of rotation is adjusted so as to maintain the first predetermined contact pressure between each blanket cylinder and its corresponding plate cylinder.

14. An offset printing machine as in claim 13 further comprising:

first and second pairs of sleeves, each pair mounted in said vertical frame walls in diametrically opposed relationship for rotation about a first axis coupling said first pivot points;

a shaft stub eccentrically mounted in each of said sleeves in diametrically opposed relationship for rotation about a second axis coupling said second pivot points;

a blanket cylinder shaft rotatably extending between and eccentrically coupled to each pair of eccentric shaft stubs for rotation about a third axis parallel to said first and second axes to enable eccentric movement of said blanket cylinder about said first and second axes; and means for sequentially rotating each of said pair of sleeves and each of said pair of eccentric shaft stubs to cause each of said blanket cylinders to move eccentrically in two steps into pressure contact engagement initially with its corresponding plate cylinder for receiving an image and subsequently with the impression cylinder to transfer said image to paper.

15. An offset printing machine as in claim 14 wherein said means for rotating each pair of said sleeves about said first pivot point further comprises:

a sleeve adjustment shaft coupled to said vertical frame walls, a first toggle lever rotatably coupled to said sleeve adjustment shaft;

an air cylinder coupled to one end of said first toggle lever for pivoting said first toggle lever about said sleeve adjustment shaft between first and second positions; and a linkage having one end coupled to at least one of said sleeves in each pair and the other end coupled to said first toggle lever such that movement of the first toggle lever between said first and second positions rotates its corresponding pair of sleeves about said first pivot point to move its corresponding blanket cylinder into and out of engagement with its corresponding master cylinder.

16. The offset printing machine as in claim 15 further comprising:

an eccentric bearing rigidly mounted to each of said sleeve adjustment shafts for rotatably receiving said first toggle levers such that rotation of each of said sleeve adjustment shafts changes the pivot point of the corresponding first toggle lever; and a first adjustment arm rigidly coupled to each of said sleeve adjustment shafts for rotating each of said sleeve adjustment shafts to position each of said eccentric bearings and changing the pivot point of the corresponding first toggle lever and the amount of rotation of the associated sleeve pair so as to change the distance of movement of each blanket cylinder toward its corresponding plate cylinder for maintaining the predetermined contact pressure between the corresponding plate cylinder and the corresponding blanket cylinder as necessary.

17. The offset printing machine as in claim 16 further including:

a first rod threadedly connected to each of the first adjustment arms;

a first adjustment wheel coupled to said frame and connected to the first rod for rotating said rod and moving each first adjustment arm in first and second directions to rotate each of the sleeve adjustment shafts and maintain the contact pressure between each blanket cylinder and its corresponding plate cylinder; and a first numerical counter coupled to the first rod for numerically registering the amount of movement of each of said first adjustment arms from a given point.

18. The offset printing machine as in claim 17 further comprising:

a cam rigidly fixed on each of said sleeve adjustment shafts; and a stop arm pivotally coupled between each of said cams and its corresponding stop mechanism such that rotation of each pair of sleeves by said first toggle levers is limited by a stop mechanism contacting each stop arm and rotation of each sleeve adjustment shaft moves each cam to change the point at which a stop arm contacts a corresponding stop mechanism thereby maintaining a desired contact pressure between each blanket cylinder and its corresponding plate cylinder.

19. The offset printing machine as in claim 18 wherein each said stop mechanism further comprises:

a mount on each sleeve;

a bolt slidably attached to the mount, said bolt having a bolt head; and a plurality of compressible springs on said bolt between said bolt head and said mount, said stop arm contacting said bolt head to slide said bolt against and compress the springs so as to maintain a constant pressure and to compensate for manufacturing tolerances and deficiencies.

20. The offset printing machine as in claim 19 further comprising:

a pair of second adjustment arms, each of said second adjustment arms having first, second and third orifices and each being attached to a side wall with a first one of said orifices;

a pair of second toggle levers, each second toggle lever coupled at a pivot point to a second one of said orifices of each of said second adjustment arms for pivotal movement about said second orifice between first and second positions;

a link coupling each of said toggle levers to a corresponding eccentric stub shaft for rotating said eccentric stub shaft about said second axis when said second toggle lever is moved between first and second positions; and a pair of air cylinders, each air cylinder coupled to one end of said second toggle levers for selectively pivoting said second toggle lever between said first and second positions to rotate the attached eccentric stub shaft.

21. The offset printing machine as in claim 20 further including:

a second rod threadedly connected to the third orifice of each of said second adjustment arms;

a second adjustment wheel coupled to said frame and connected to the second rod for rotating said rod and simultaneously moving each second adjustment arm in first and second directions to move the pivot point of each of said second toggle levers to maintain the contact pressure between each blanket cylinder and the impression cylinder; and a second numerical counter coupled to the second rod for numerically registering the amount of movement of each of said second adjustment arms from a given point.

* * * * *

UNITED STATES PATENT AND TRADEMARK OFFICE

CERTIFICATE OF CORRECTION

PATENT NO. : 5,094,162

DATED : March 10, 1992

INVENTOR(S) : Leonard I. Tafel
Theodore Costopoulos

It is certified that error appears in the above—identified patent and that said Letters Patent is hereby corrected as shown below:

Column 17, line 54, "print" should be --point--.

Signed and Sealed this

Fifteenth Day of June, 1993

Attest:

Michael K. Kirk

MICHAEL K. KIRK

Attesting Officer

Acting Commissioner of Patents and Trademarks